United States Patent [19]

Armstrong et al.

[11] 4,185,653

[45] Jan. 29, 1980

[54] LIQUID METERING AND MIXING DEVICE

[76] Inventors: Dan H. Armstrong, 1435 Slate Run Rd.; Larry G. Kamerer, 2402 Lyon La., both of New Albany, Ind. 47150

[21] Appl. No.: 852,193

[22] Filed: Nov. 17, 1977

[51] Int. Cl.[2] ..... B67D 5/04

[52] U.S. Cl. ..... 137/114; 137/499; 222/57

[58] Field of Search ..... 137/98, 99, 114, 499, 137/624.14, 119; 222/57; 251/259

[56] References Cited

U.S. PATENT DOCUMENTS

| | | | |
|---|---|---|---|
| 912,816 | 2/1909 | Creighton | 251/259 |
| 1,226,108 | 5/1917 | Olney | 222/57 |
| 3,163,394 | 12/1964 | Downin | 251/259 |
| 3,168,113 | 2/1965 | McJohnson | 251/259 |
| 3,575,535 | 4/1971 | Bickar | 137/99 |
| 3,642,171 | 2/1972 | Ernst | 137/98 |
| 4,022,239 | 5/1977 | Schwindt et al. | 137/119 |

FOREIGN PATENT DOCUMENTS

| | | | |
|---|---|---|---|
| 65551 | 8/1947 | Denmark | 137/114 |
| 1289973 | 5/1961 | France | 251/259 |

*Primary Examiner*—William R. Cline
*Assistant Examiner*—H. Jay Spiegel
*Attorney, Agent, or Firm*—Charles G. Lamb; Charles G. Lamb

[57] ABSTRACT

A liquid metering and mixing device specifically for the metering and mixing of gasoline and oil for a two-cycle engine wherein addition of gasoline to a rotatably mounted measuring member for a gasoline tank actuates a valve means which opens for a short period of time letting a small amount of oil into the measuring member.

3 Claims, 1 Drawing Figure

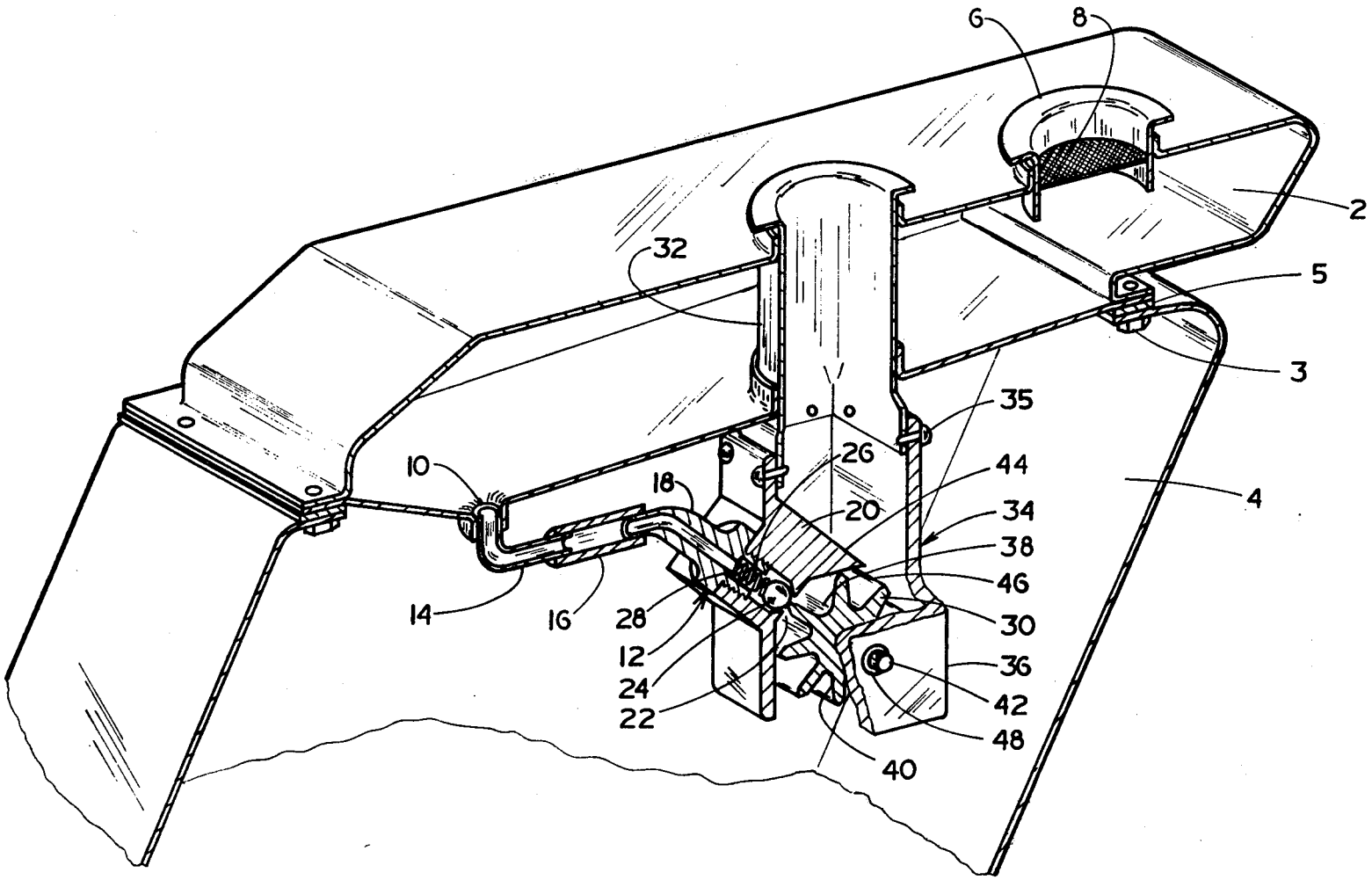
2
5
3
4
8
6
35
44
34
38
46
30
36
42
48
40
26
20
32
18
28
12
24
22
16
10
14

LIQUID METERING AND MIXING DEVICE

BACKGROUND OF THE INVENTION (1) Field of the Invention

This invention relates to liquid metering and mixing devices and more particularly relates to a metering device for gasoline and oil for use with two-cycle engines.

(2) Description of the Prior Art

In the operation of two-cycle engines the lubricating oil for these engines is generally mixed with gasoline in a gasoline feed tank. Addition of the oil to the gasoline is usually performed by adding a predetermined amount of gasoline to the tank and then the operator pours in a small amount of oil as determined by the amount of gasoline added. Many devices have been tried to eliminate the manual mixing of the oil with gasoline, but most of these devices have proven to be complex and expensive. Thus, for a two-cycle engine which is relatively inexpensive in itself, the cost of an automatic metering device in proportion to the cost of the engine is relatively high.

SUMMARY OF THE INVENTION

The present invention advantageously provides a straightforward arrangement for a liquid metering and mixing device for two liquids which is inexpensive, as well as easy and quickly operable. Futhermore, the present invention provides a metering and mixing device for mixing oil and gasoline specifically for a two-cycle engine wherein the device includes a freely rotatable member with a plurality of receptacles therein mounted within a tank whereby movement of the member occurs in response to filling of each receptacle, the movement of the rotatable member actuating means for adding oil to the tank.

Various other features of the present invention will become obvious to those skilled in the art upon reading the disclosure set forth hereinafter.

More particularly, the present invention provides a liquid metering and mixing device for two liquids comprising: a housing; a rotatable measuring member mounted transversely to opposite sides of said housing, said measuring member including a plurality of liquid receptacles circumferentially spaced around the axis of the measuring member, said rotatable member gravitationally movable in response to filling of one of said reeptacles with a first liquid from a first liquid source; and, a valve means having an inlet in flow communication with a second liquid source and an outlet in flow communication with said measuring member, said outlet being opened and closed in response to movement of said measuring member.

It is to be understood the the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing:

The FIGURE is a perspective view, with selected portions cut-away, of a preferred liquid metering and mixing device of the present invention.

DESCRIPTION OF THE PREFERRED EMBODIMENT

In the FIGURE, a liquid metering and mixing device of the present invention is shown. The device includes a chamber or oil reservoir 2 for receiving oil therein mounted onto a gas tank 4. Mounting of reservoir 2 to tank 4 generally includes a plurality of bolts 3 equally spaced around mating flange portions of reservoir 2 and tank 4 with a sealing gasket 5 disposed therebetween. Reservoir 2 has an oil inlet 6 with a screen 8 transversely mounted across the inlet 6 for removing particulates from the oil upon addition to the reservoir 2. Reservoir 2 is also provided with an outlet 10 in flow communication with a valve assembly 12. Outlet 10 includes a conduit 14, fixedly attached at one end, generally by welding, to the reservoir 2.

Valve assembly 12 is provided with a flexible tubing connector 16, usually of a plastic material, which matingly receives at one end, the other end of conduit 14 in sealing relation and the other end of connector 16 matingly receives the inlet of the fluid inlet member 18. The outlet of the fluid inlet member 18 is threadably received by a valve body 20. The valve body 20 includes a seat 22 therein and a valve ball 24 in an opening and closing relation with the seat 22. Valve ball 24 is held in a normally closed position by a ball retaining spring 26 which has one end forcibly retaining pressure upon the ball 24 with the opposite end received by a recess designated by the numeral 28 in the outlet of the fluid inlet member 18. Operation of the ball 24 is in response to rotatable movement of rotatable member 30, to be discussed hereinafter.

Reservoir 2 is further provided with aligned openings in the top and bottom to receive a tubular conduit 32 therethrough, tubular conduit 32 being disposed to receive gasoline therein. Tubular conduit 32 is provided with an outlet opening in flow communication with mixing assembly 34. Mixing assembly 34 is attached to conduit 32 by any known means, such as rivets 35. Mixing assembly 34 includes a housing 36, housing 36 having the transversely extending rotatable measuring member 30 mounted therein. Rotatable member 30 has a plurality of liquid rceptacles 38 circumferentially spaced around the axis of the member 30, each receptacle being defined by opposing walls of housing 36 and adjacent outwardly extending vanes 40 of the member 30.

The rotatable member 30 is provided with a shaft 42 which extends therethrough and is received in opposed aligned receiving mounts 48 mounted in opposite walls of housing 36 providing freely rotatable means for member 30.

The valve body 20 is provided with an inclined surface 44 which extends transversely from one side of housing 36 to the opposite side. Surface 44 is positioned to deflect or direct incoming gasoline into individual receptacles 38. By directing the flow of gasoline into individual receptacles 38, one at a time, the weight of the gasoline forces rotation of the rotatable member 30 downwardly.

Each vane 40 is provided with an outwardly extending finger portion 46 which engages with the ball 24 upon passing thereby. Thus, as the gasoline fills a receptacle 38 to an amount sufficient to force the rotatable member 30 to turn, one of the fingers 46 engages with the ball 24 and urges the ball 24 off of the seat 22 thereby providing a momentary passage through the created opening to allow for a few drops of oil to enter one of the receptacles 38 of the mixing valve member 30, the addition occurring as long as gasoline is being added to tubular member 32.

In operation, when the oil drops into receptacle 38, the oil is then carried around upon further movement of member 30 over the finger portion 46 where the first liquid (gasoline) collides with the second liquid (oil) with force sufficient to effect intimate contact and thorough mixing of the two liquids.

It is realized that various changes may be made to the specific embodiment shown and described without departing from the principles and scope of the present invention.

What is claimed is:

1. A liquid metering and mixing device for two liquids comprising:

a housing;

a rotatable measuring member mounted transversely to opposite sides of said housing, said measuring member including a plurality of liquid receptacles and a plurality of outwardly extending fingers circumferentially spaced around the axis of the measuring member, said rotatable member moves in reponse to filling of one of said receptacles with a first liquid from a first liquid source; and, a valve means having an inlet in flow communication with a second liquid source and an outlet in flow communication with said measuring member, said valve means including a valve body with a seat therein, a valve ball disposed in opening and closing relation with said seat, and a ball retaining spring received within said valve body and in retaining position with said valve ball, said valve ball being movable in response to engagement with said outwardly extending fingers of said measuring member whereby said first liquid and said second liquid are mixed in said receptacles.

2. The liquid metering and mixing device of claim 1, said valve body having an outer surface inclined and in flow alignment with individual receptacles of said rotatable measuring member whereby said first liquid entering said housing is directed into individual receptacles.

3. The liquid metering and mixing device of claim 1, said liquid receptacles disposed for receiving liquid from said second liquid source prior to receiving liquid from said first liquid source.

* * * * *